US009655387B2

(12) United States Patent
Yip

(10) Patent No.: US 9,655,387 B2
(45) Date of Patent: May 23, 2017

(54) BREAST SUPPORT FOR A GARMENT OR GARMENT PART

(71) Applicant: Clover Mystique Co. Limited, Kowloon, Hong Kong (HK)

(72) Inventor: Kwan Yin Yip, Hong Kong (CN)

(73) Assignee: Clover Mystique Co. Limited (HK)

( * ) Notice: Subject to any disclaimer, the term of this patent is extended or adjusted under 35 U.S.C. 154(b) by 58 days.

(21) Appl. No.: 14/687,852

(22) Filed: Apr. 15, 2015

(65) Prior Publication Data

US 2016/0302493 A1 Oct. 20, 2016

(51) Int. Cl.

| | |
|---|---|
| ***A41C 3/12*** | (2006.01) |
| ***A41C 3/08*** | (2006.01) |
| ***A41C 5/00*** | (2006.01) |
| ***A41C 3/00*** | (2006.01) |

(52) U.S. Cl.

CPC ..... *A41C 3/12* (2013.01); *A41C 3/0014* (2013.01); *A41C 3/08* (2013.01); *A41C 5/00* (2013.01)

(58) Field of Classification Search

CPC ..... A41C 3/00; A41C 3/122; A41C 3/128; A41C 3/007; A41C 3/12

USPC ..... 450/41–53, 60–79, 80, 86; 2/260.1

See application file for complete search history.

(56) References Cited

U.S. PATENT DOCUMENTS 3,114,374 A * 12/1963 Chalfin ..... A41C 3/122 2/260.1
6,431,946 B1 8/2002 Fildan et al.
6,435,939 B1 * 8/2002 Lin ..... A41C 3/128 450/41
6,447,365 B1 * 9/2002 Powell ..... A41C 3/122 450/41
6,966,815 B2 11/2005 Weinerth
8,747,184 B2 * 6/2014 Liu ..... A41C 3/0007 450/41
2009/0130953 A1 5/2009 Gransberry (Continued)

FOREIGN PATENT DOCUMENTS

| | | |
|---|---|---|
| CN | 1678209 A | 10/2005 |
| CN | 2912286 Y | 6/2007 |
| CN | 200994418 Y | 12/2007 |

(Continued)

OTHER PUBLICATIONS

Search Report by the Intellectual Property Office of Great Britain under Section 17 of the Patents Act of 1977, application No. GB1507227.5, search report dated Sep. 24, 2015, 1 page.

(Continued)

*Primary Examiner* — Gloria Hale

(74) *Attorney, Agent, or Firm* — Ware, Fressola, Maguire & Barber LLP

(57) ABSTRACT

A breast support (12*a*, 12*b*) for a garment or garment part is disclosed as including a first piece of elongate resilient material formed by a piece of substantially straight resilient material (16*a*, 16*b*) with a first planar major surface, and a second piece of elongate resilient material formed by a piece of arcuate resilient material (14*a*, 14*b*) with a second planar major surface (18), an inner arcuate edge (13*a*, 13*b*) and an outer arcuate edge (15*a*, 15*b*), the first piece of elongate resilient material (16*a*, 16*b*) being fixedly engaged and in contact with the second piece of elongate resilient material (14*a*, 14*b*) along the whole length of the first piece of elongate resilient material (16*a*, 16*b*).

21 Claims, 7 Drawing Sheets

(56) References Cited

U.S. PATENT DOCUMENTS

| | | | | |
|---|---|---|---|---|
| 2011/0159780 | A1 | 6/2011 | Yao | |
| 2012/0184181 | A1* | 7/2012 | Liu | A41C 3/0007 450/60 |

FOREIGN PATENT DOCUMENTS

| | | | |
|---|---|---|---|
| CN | 101917878 | A | 12/2010 |
| CN | 202077593 | U | 12/2011 |
| CN | 202552143 | U | 11/2012 |
| DE | 202006002923 | U1 | 8/2006 |
| EP | 2842440 | A2 | 3/2015 |
| GB | 2 390 968 | A | 1/2004 |
| JP | 2001020116 | A | 1/2001 |
| JP | 2003301355 | A | 10/2003 |

OTHER PUBLICATIONS

Notification of Transmittal of the International Search Report (ISR) and the Written Opinion of the International Search Authority (ISA), Form PCT/ISA/220, mailed Jan. 28, 2016 (3 pages); ISR, Form PCT/ISA/210, (4 pages); Written Opinion, Form PCT/ISA/237, (4 pages); 11 pages total.

Search Report for Hong Kong short-term patent application, State Intellectual Property Office of the People's Republic of China, Application No. 15103982.7, search completed May 12, 2015, mailed May 15, 2015, six pages total.

Bibliographic data including English Abstract, Document DE202006002923U1, published Aug. 17, 2006.

* cited by examiner

Fig. 5
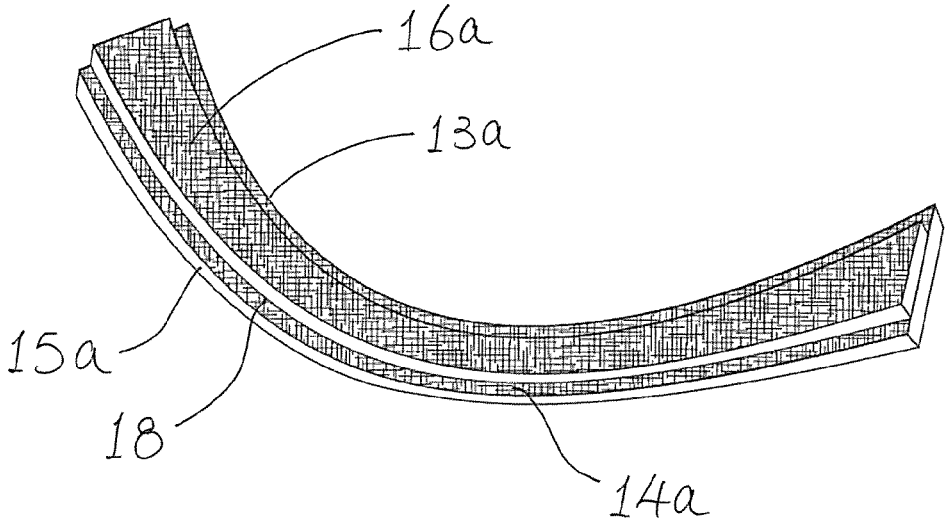
Fig. 6
Fig. 7
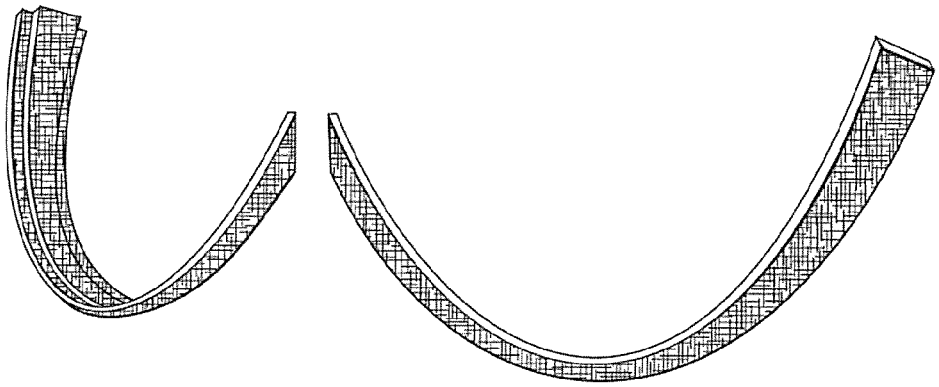

BREAST SUPPORT FOR A GARMENT OR GARMENT PART

This invention relates to a breast support for a garment or garment part, including, but not limited to, brassieres, unlined brassieres, swimwear, sports bra, crop tops, sports tops, sleepwear, lingerie, intimate apparel, shapewear, corsets, wedding gowns and brassiere pads, a garment or garment part with such a breast support, a method of forming such a breast support and a method of forming a garment or garment part with such a breast support.

BACKGROUND OF THE INVENTION

Existing brassieres generally have pads to provide support for the breasts of a wearer. For this purpose, such pads are usually provided with a metal wire or plastic wire along and adjacent a lower side in order to provide support to and enhance the shape of the breasts of the wearer. However, such conventional brassieres suffer from one or more of the following disadvantages:

(a) such a metal wire or plastic wire is usually in the form of a U shape, which is not shaped to meet the horizontal cross sectional curvature of the body, and thus the wire does not fit the body of the wearer properly;

(b) the U-shaped wire also causes discomfort to the wearer as it presses against the ribs of the wearer or even digs into the flesh in the underarm region of the wearer; and (c) a metal wire may cause serious damage to the brassieres during washing and drying cycles, such that the wire may poke through a wire channel in the brassieres, and poke out from the side or bottom of the brassieres to cause injury or discomfort to the wearer.

It is thus an objective of the present invention to provide a breast support for a garment or garment part, a garment or garment part with such a breast support, a method of forming such a breast support and a method of forming a garment or garment part with such a breast support in which the aforesaid shortcomings are mitigated or at least to provide a useful alternative to the trade and public.

SUMMARY OF THE INVENTION

According to a first aspect of the present invention, there is provided a breast support for a garment or garment part, said breast support comprising a first piece of elongate resilient material formed by a piece of resilient material with a first planar major surface and of a first curvature, and a second piece of elongate resilient material formed by a piece of resilient material with a second planar major surface and of a second curvature which is different from the first curvature, wherein said first piece of elongate resilient material is fixedly engaged and in contact with said second piece of elongate resilient material along at least a majority of the length of said first piece of elongate resilient material.

According to a second aspect of the present invention, there is provided a garment or garment part including at least one breast support for a garment or garment part, said breast support comprising a first piece of elongate resilient material formed by a piece of resilient material with a first planar major surface and of a first curvature, and a second piece of elongate resilient material formed by a piece of resilient material with a second planar major surface and of a second curvature which is different from the first curvature, wherein said first piece of elongate resilient material is fixedly engaged and in contact with said second piece of elongate resilient material along at least a majority of the length of said first piece of elongate resilient material.

According to a third aspect of the present invention, there is provided a method of forming a breast support for a garment or garment part, said method comprising (a) providing a first piece of elongate material with a first planar major surface and of a first curvature, (b) providing a second piece of elongate resilient material with a second planar major surface and of a second curvature which is different from the first curvature, and (c) fixedly engaging and contacting said first piece of elongate resilient material with said second piece of elongate resilient material along at least a majority of the length of said first piece of elongate resilient material.

According to a fourth aspect of the present invention, there is provided a method of forming a garment or garment part including incorporating at least one breast support in a garment or garment part, wherein said at least one breast support is formed by (a) providing a first piece of elongate material with a first planar major surface and of a first curvature, (b) providing a second piece of elongate resilient material with a second planar major surface and of a second curvature which is different from the first curvature, and (c) fixedly engaging and contacting said first piece of elongate resilient material with said second piece of elongate resilient material along at least a majority of the length of said first piece of elongate resilient material.

BRIEF DESCRIPTION OF THE DRAWINGS

Embodiments of the present invention will now be described, by way of examples only, with reference to the accompany drawings, in which:

FIG. 5 shows one of the pieces of straight elongate resilient material and one of the pieces of arcuate elongate resilient material of FIG. 4 in contact with each other for forming a breast support according to the present invention;

FIG. 6 shows a first breast support according to the present invention;

FIG. 7 shows a second breast support according to the present invention;

DESCRIPTION OF THE EMBODIMENTS

Figure 1:
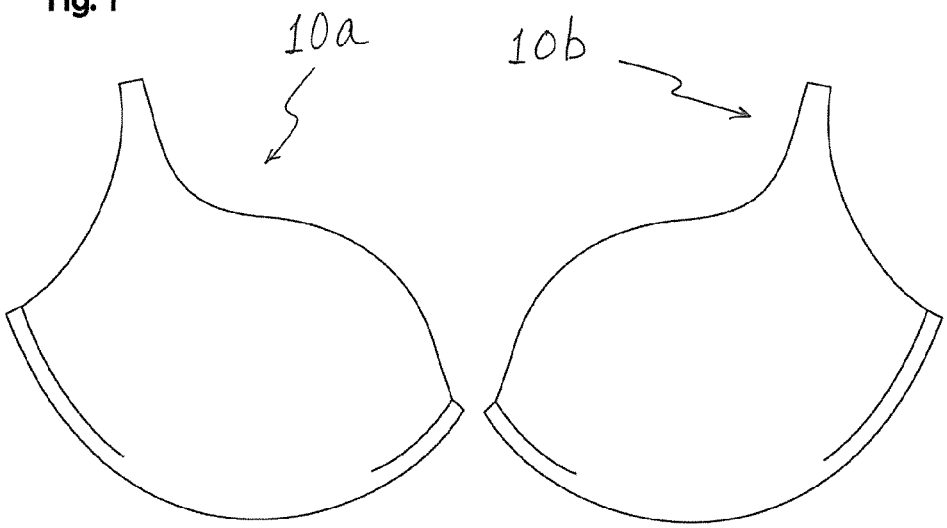
FIG. 1 is a front view of two brassiere pads, each including a breast support for a garment or garment part according to the present invention.
Figure 2:
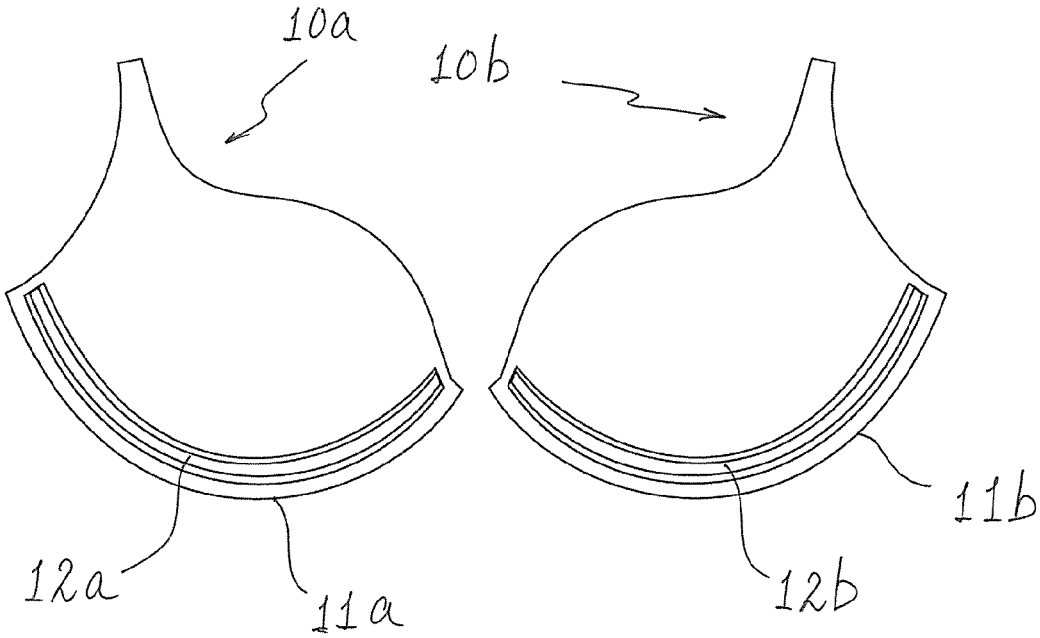
FIG. 2 is an inside view of the two brassiere pads of FIG. 1.
Figure 3:
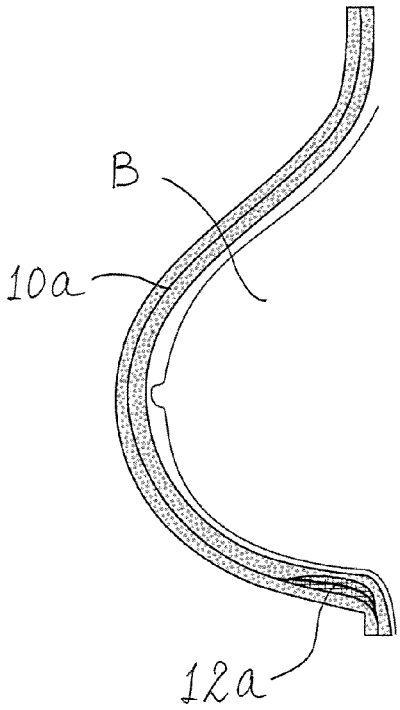
FIG. 3 is a side sectional view of one of the brassiere pads of FIG. 1, shown as supporting a breast of a wearer.

FIG. 1 shows a front view of two brassiere pads, generally designated as 10*a* and 10*b* respectively, and FIG. 2 is an inside view of the brassiere pads 10*a*, 10*b*. Each of the brassiere pads 10*a*, 10*b* is fixedly embedded with a breast support 12 according to the present invention along and adjacent their respective lower sides 11*a*, 11*b*. As shown in more detail in FIG. 3, when a brassiere (not shown) incorporating the two brassiere pads 10*a*, 10*b* is worn by a wearer, and taking the breast support 12*a* within the brassiere pad 10*a* as an example, the breast support 12*a* is under and provides support to a breast (B) of the wearer.

Figure 4:
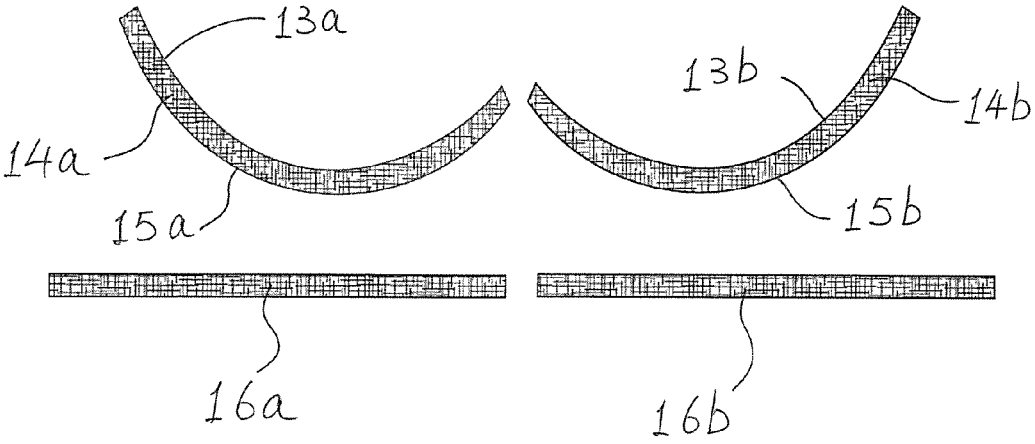
FIG. 4 shows two pieces of arcuate elongate resilient material and two pieces of straight elongate resilient material for making two breast supports according to the present invention.

The breast support 12*a* is made of a piece of arcuate elongate resilient material 14*a* and a piece of straight elongate resilient material 16*a*; and the breast support 12*b* is made of a piece of arcuate elongate resilient material 14*b* and a piece of straight elongate resilient material 16*b*. FIG. 4 shows the top views of the two pieces of arcuate elongate resilient material 14*a*, 14*b* and the two pieces of straight elongate resilient material 16*a*, 16*b*. The straight elongate resilient material 16*a*, 16*b* on the one hand and the arcuate elongate resilient material 14*a*, 14*b* on the other hand are of different curvatures. Each of the two pieces of arcuate elongate resilient material 14*a*, 14*b* and the two pieces of straight elongate resilient material 16*a*, 16*b* has respectively an upper planar major surface and a lower planar major surface which are parallel to each other. The arcuate elongate resilient material 14*a* has an inner arcuate edge 13*a* and an outer arcuate edge 15*a*, both adjoining the upper and lower surfaces of the arcuate elongate resilient material 14*a*. The outer arcuate edge 15*a* is longer than the inner arcuate edge 13*a*. The arcuate elongate resilient material 14*b* has an inner arcuate edge 13*b* and an outer arcuate edge 15*b*, both adjoining the upper and lower surfaces of the arcuate elongate resilient material 14*b*. The outer arcuate edge 15*b* is longer than the inner arcuate edge 13*b*.

Though not strictly necessary, the length of the inner arcuate edge 13*a* of the piece of arcuate elongate resilient material 14*a* is usually longer than the length of the piece of straight elongate resilient material 16*a*; and the length of the inner arcuate edge 13*b* of the piece of arcuate elongate resilient material 14*b* is usually longer than the length of the piece of straight elongate resilient material 16*b*.

The two pieces of arcuate elongate resilient material 14*a*, 14*b* and the two pieces of straight elongate resilient material 16*a*, 16*b* may be made of the same material or different materials. In particular, they may each be made of ethylene vinyl acetate, compressed polyurethane, compressed fibrefill, and/or a resilient coated fabric, so that the pieces of arcuate elongate resilient material 14*a*, 14*b* and the pieces of straight elongate resilient material 16*a*, 16*b* are resilient when bent to form a curve. More particularly, while the two pieces of arcuate elongate resilient material 14*a*, 14*b* and the two pieces of straight elongate resilient material 16*a*, 16*b* may each be bent into a curved shape, they are resilient to such bending and tend to return to their stable original shape in which their respective upper and lower surfaces are planar.

To form the breast support 12*a*, and as shown in FIG. 5, the piece of straight elongate resilient material 16*a* is placed on the piece of arcuate elongate resilient material 14*a* such that a lower planar major surface of the piece of straight elongate resilient material 16*a* is in contact with an upper planar major surface 18 of the piece of arcuate elongate resilient material 14*a*. The piece of arcuate elongate resilient material 14*a* and the piece of straight elongate resilient material 16*a* are then fixedly engaged with each other, by sewing and/or lamination, along at least a majority of the length (e.g. along the whole length) of the piece of straight elongate resilient material 16*a*. Because of the difference between the length of the inner arcuate edge 13*a* of the piece of arcuate elongate resilient material 14*a* and the length of the piece of straight elongate resilient material 16*a*, the resultant breast support 12*a* is forced to form a curved shape and is resilient to any further change of shape. More particularly, when the breast support 12*a* is in the curved shape as shown in FIG. 6 or 7, it will remain in this stable curved shape unless subject to external force. While the breast support 12*a* may be bent by an external force to change its shape (curvature), when the external force is removed, it will return to the stable curved shape. Because of such a characteristic, the breast support 12*a* will provide support to a breast of a wearer of a garment or garment part incorporating the breast support 12*a*.

The curvature of the resultant breast support 12*a* depends mainly on the curvature of the piece of arcuate elongate resilient material 14*a*. Thus, the breast support 12*a* formed of the piece of straight elongate resilient material 16*a* and the piece of arcuate elongate resilient material 14*a* may be of a first curvature as shown in FIG. 6, or may be of a second curvature as shown in FIG. 7, depending on the curvature of the piece of arcuate elongate resilient material 14*a*. It should be noted in this connection that the word "arcuate" in the present invention should not be understood in the strict geometrical sense. It thus means that the piece of arcuate elongate resilient material 14*a* needs not be in the exact shape of part of a circumference of a circle, but that its shape only needs to loosely resemble that of an arc.

Figure 8:
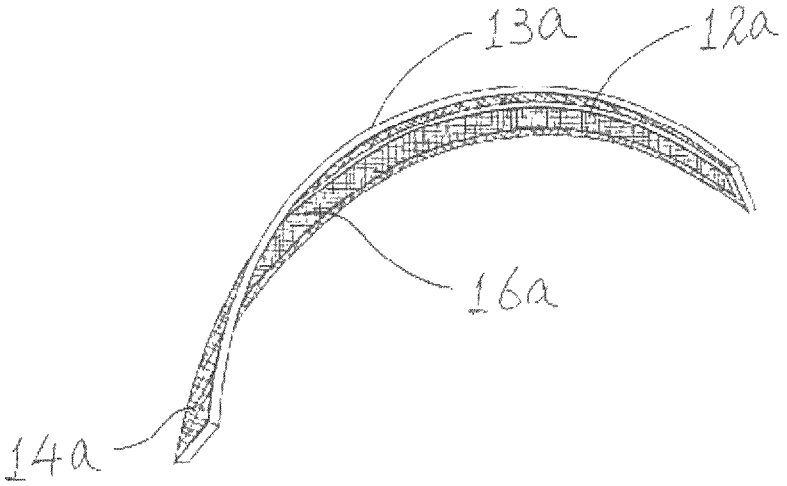
FIG. 8 shows a top perspective view of a breast support according to the present invention.
Figure 9:
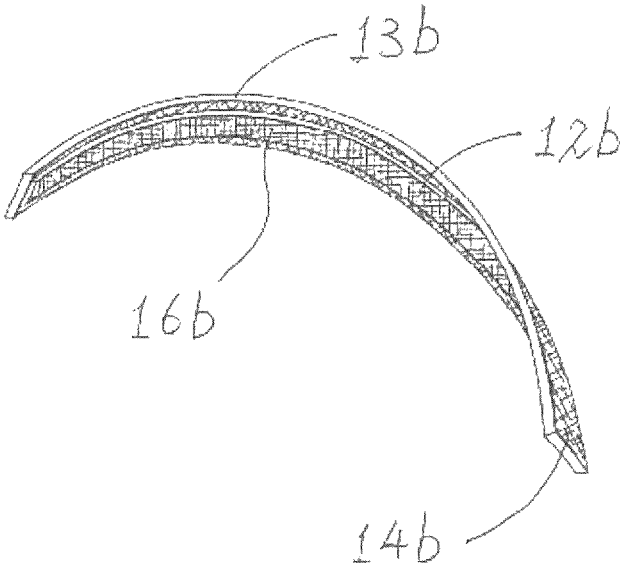
FIG. 9 shows a top perspective view of a further breast support according to the present invention.

FIG. 8 shows the breast support 12*a* and FIG. 9 shows the breast support 12*b*, both sitting on a horizontal surface. It is found that the breast supports 12*a*, 12*b* are of such a resilience that they can both stably sit on a horizontal surface with the respective outer arcuate edge 15*a*, 15*b* of their respective piece of arcuate elongate resilient material 14*a*, 14*b* in contact with the horizontal surface and the respective inner arcuate edge 13*a*, 13*b* of their respective piece of arcuate elongate resilient material 14*a*, 14*b* above and spaced apart from the horizontal surface.

Figure 10:
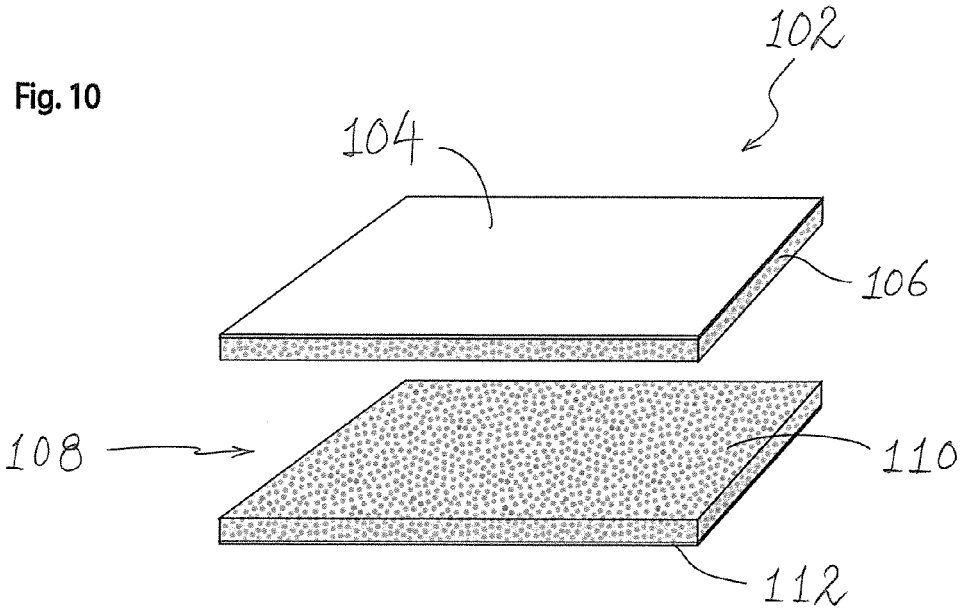
FIGS. 10 to 18 show a method for manufacturing the two brassiere pads of FIG. 1 according to the present invention.

FIGS. 10 to 18 show a method for manufacturing the brassiere pads 10*a*, 10*b* of FIG. 1 according to the present invention. FIG. 10 shows a first piece of precursor material 102 formed of a layer of fabric material 104 and a layer of foam material 106 fixedly engaged with each other by an adhesive and/or heat lamination, and a second piece of precursor material 108 formed of a layer of foam material 110 and a layer of fabric material 112 fixedly engaged with each other by an adhesive and/or heat lamination.

Figure 11:
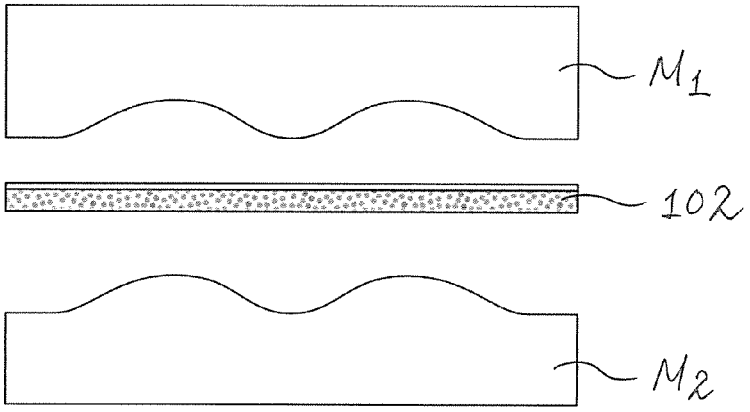
Figure 12:
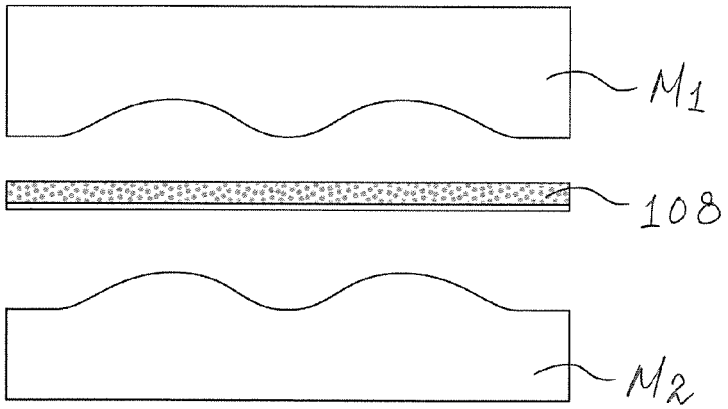
Figure 13:
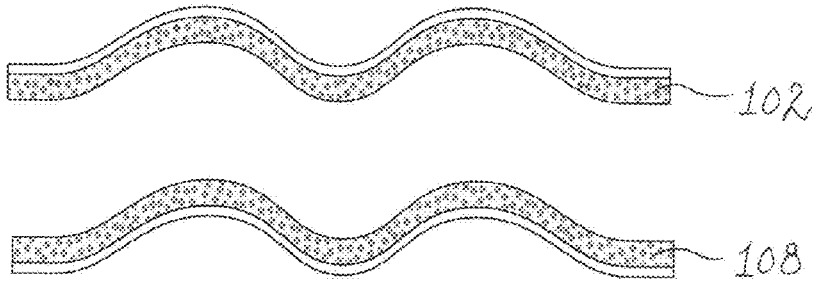

As shown in FIG. 11, the first piece of precursor material 102 is placed between an upper mold $M_1$ and a lower mold $M_2$ of a mold to be molded (by pressure and preferably with heat as well) to form at least two cup-shaped portions, as shown in FIG. 13. Similarly, and as shown in FIG. 12, the second piece of precursor material 108 is placed between the upper mold $M_1$ and lower mold $M_2$ to be molded (by pressure and preferably with heat as well) to form at least two cup-shaped portions, again as shown in FIG. 13.

Figure 14:
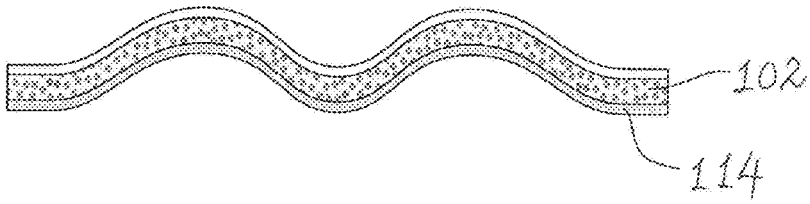

As shown in FIG. 14, a layer of adhesive 114 is applied to the layer of foam material 106 of the molded first piece of precursor material 102 which, when the brassiere pads 10*a*, 10*b* are duly assembled, contacts the molded second piece of precursor material 108. Alternatively or in addition, a layer of adhesive is applied to the layer of foam material 110 of the molded second piece of precursor material 108 which, when the brassiere pads 10*a*, 10*b* are duly assembled, contacts the molded first piece of precursor material 102.

Figure 15:
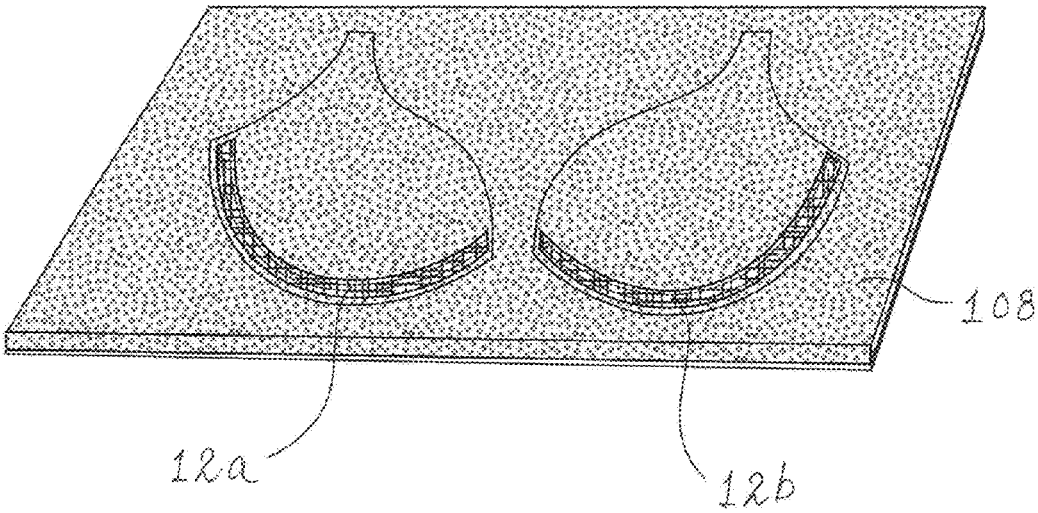
Figure 16:
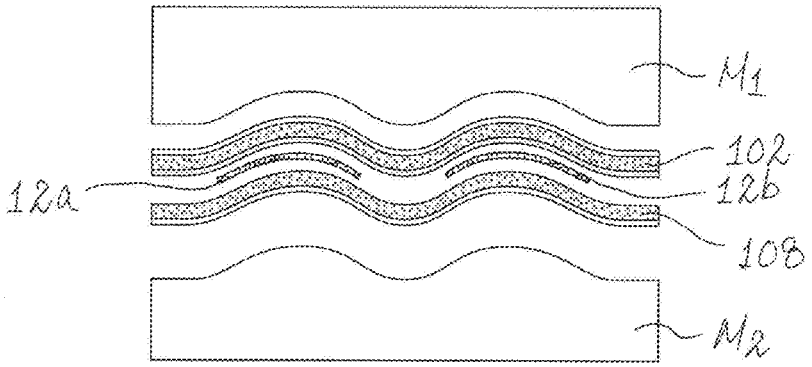

The breast supports 12*a*, 12*b* are then placed on the molded second piece of precursor material 108, as shown in FIG. 15. Further as shown in FIG. 16, the molded first piece of precursor material 102, the molded second piece of precursor material 108, with the breast supports 12*a*, 12*b* in between, are placed within the upper mold $M_1$ and lower mold $M_2$ for molding by pressure and preferably with heat as well. Although the breasts supports 12*a*, 12*b* are shown in FIG. 16 as being spaced away from the molded second piece of precursor material 108, it should be understood that, as mentioned earlier, the breast supports 12*a*, 12*b* are placed on the molded second piece of precursor material 108.

Figure 17:
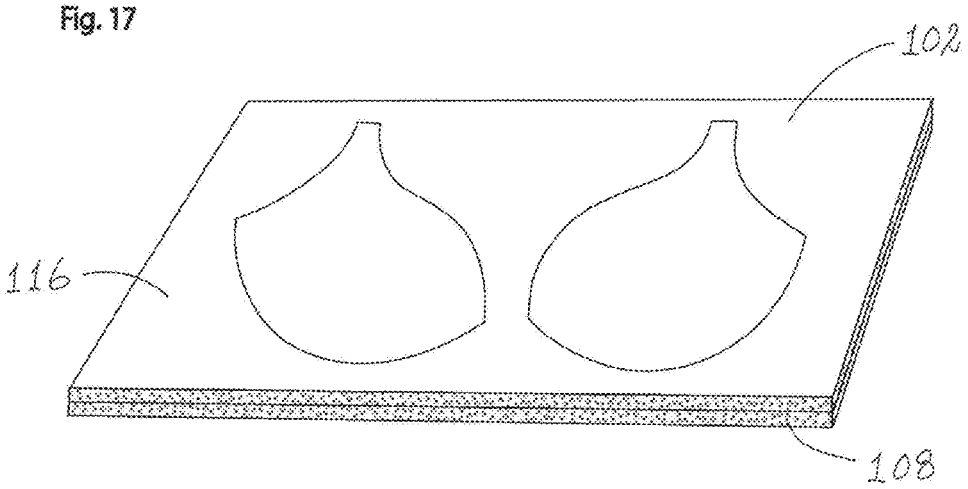
Figure 18:
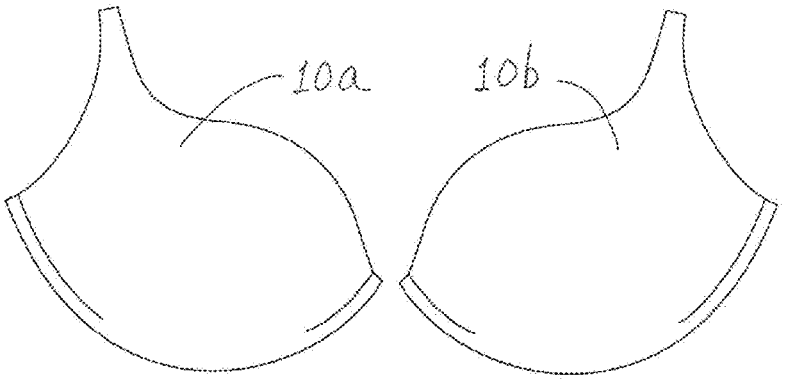

FIG. 17 shows the molded first piece of precursor material 102, molded second piece of precursor material 108, with the breast supports 12*a*, 12*b* in between, after being released from the mold comprising the upper mold $M_1$ and lower mold $M_2$ subsequent to further molding to form an integral laminated material 116. The brassiere pads 10*a*, 10*b*, as shown in FIG. 18, are then formed by being cut out from the integral laminated material 116.

The brassiere pads 10*a*, 10*b* may be used for forming a brassiere, or may be incorporated in other garments, e.g. swimwear. In addition, although the invention has thus far been discussed in the context in which the breast supports 12*a*, 12*b* are incorporated in the brassiere pads 10*a*, 10*b* by molding, it is envisaged that the breast supports 12*a*, 12*b* may be incorporated in the brassiere pads 10*a*, 10*b* by sewing and/or adhesive. Furthermore, the breast supports 12*a*, 12*b* may also be directly incorporated, e.g. by molding, sewing and/or adhesive, in other garments or garment parts, such as unlined brassieres, swimwear, sports bra, crop tops, sports tops, sleepwear, lingerie, intimate apparel, shapewear, corsets and wedding gowns.

It should be understood that the above only illustrates and describes examples whereby the present invention may be carried out, and that modifications and/or alterations may be made thereto without departing from the spirit of the invention. For example, while the invention has thus far been described in the context in which the breast support is made of a piece of straight elongate resilient material and a piece of arcuate elongate resilient material, it is envisaged that such can also be made of two pieces of arcuate elongate resilient material, each of a different curvature.

It should also be understood that certain features of the invention, which are, for clarity, described in the context of separate embodiments, may also be provided in combination in a single embodiment. Conversely, various features of the invention which are, for brevity, described in the context of a single embodiment, may also be provided or separately or in any suitable sub-combination.

What is claimed is:

1. A breast support for a garment or garment part, said breast support comprising:

a first piece of elongate resilient material formed by a piece of resilient material with a first planar major surface, of a first curvature, and with a length, and a second piece of elongate resilient material formed by a piece of resilient material with a second planar major surface and of a second curvature which is different from the first curvature, wherein said first piece of elongate resilient material is fixedly engaged and in contact with said second piece of elongate resilient material along at least a majority of said length of said first piece of elongate resilient material, and wherein said first piece of elongate resilient material and said second piece of elongate resilient material are fixedly engaged and in contact with each other only via said first planar major surface of said first piece of elongate resilient material and said second planar major surface of said second piece of elongate resilient material.

2. A breast support according to claim 1 wherein said first piece of elongate resilient material is substantially straight and said second piece of elongate resilient material is arcuate.

3. A breast support according to claim 1 wherein said second piece of elongate resilient material has an inner arcuate edge and an outer arcuate edge.

4. A breast support according to claim 3 wherein said first piece of elongate resilient material is shorter than said inner arcuate edge of said second piece of elongate resilient material.

5. A breast support according to claim 1 wherein said first piece of elongate resilient material is fixedly engaged and in contact with said second piece of elongate resilient material along substantially the whole of said length of said first piece of elongate resilient material.

6. A breast support according to claim 1 wherein said first piece of elongate resilient material is made of any one of ethylene vinyl acetate, compressed polyurethane, compressed fiberfill and a resilient coated fabric.

7. A breast support according to claim 1 wherein said second piece of elongate resilient material is made of any one of ethylene vinyl acetate, compressed polyurethane, compressed fiberfill and a resilient coated fabric.

8. A breast support according to claim 1 wherein said first piece of elongate resilient material and said second piece of elongate resilient material are made of a same material or different materials.

9. A breast support according to claim 1 wherein said first piece of elongate resilient material is fixedly engaged with said second piece of elongate resilient material by sewing and/or lamination.

10. A garment or garment part including at least one breast support according to claim 1.

11. A method of forming a breast support for a garment or garment part, said method comprising:

(a) providing a first piece of elongate material with a first planar major surface, of a first curvature, and with a length, (b) providing a second piece of elongate resilient material with a second planar major surface and of a second curvature which is different from the first curvature, and (c) fixedly engaging and contacting said first piece of elongate resilient material with said second piece of elongate resilient material along at least a majority of said length of said first piece of elongate resilient material, wherein said first piece of elongate resilient material and said second piece of elongate resilient material are fixedly engaged and in contact with each other only via said first planar major surface of said first piece of elongate resilient material and said second planar major surface of said second piece of elongate resilient material.

12. A method according to claim 11 wherein said first piece of elongate resilient material is substantially straight and said second piece of elongate resilient material is arcuate.

13. A method according to claim 11 wherein said second piece of elongate resilient material has an inner arcuate edge and an outer arcuate edge.

14. A method according to claim 11 wherein said first piece of elongate resilient material is shorter than the inner arcuate edge of said second piece of elongate resilient material.

15. A method according to claim 13 wherein said first piece of elongate resilient material is fixedly engaged and in contact with said second piece of elongate resilient material along substantially the whole length of said first piece of elongate resilient material.

16. A method according to claim 11 wherein said first piece of elongate resilient material is made of any one of ethylene vinyl acetate, compressed polyurethane, compressed fiberfill and a resilient coated fabric.

17. A method according to claim 11 wherein said second piece of elongate resilient material is made of any one of ethylene vinyl acetate, compressed polyurethane, compressed fiberfill and a resilient coated fabric.

18. A method according to claim 11 wherein said first piece of elongate resilient material and said second piece of elongate resilient material are made of a same material or different materials.

19. A method according to claim 11 wherein, in said step (c), said first piece of elongate resilient material is fixedly engaged with said second piece of elongate resilient material by sewing and/or heat lamination.

20. A method of forming a garment or garment part including incorporating at least one breast support formed by a method according to claim 11 in a garment or garment part.

21. A method according to claim 20 wherein said at least one breast support is incorporated in said garment or garment part by molding, sewing and/or adhesive.

* * * * *